US007334684B1

(12) United States Patent
Fontanilla et al.

(10) Patent No.: US 7,334,684 B1
(45) Date of Patent: Feb. 26, 2008

(54) VERSATILE LUNCH BOX

(76) Inventors: Elisea A. Fontanilla, 12871 Osborne St., Arleta, CA (US) 91331-3335; Erica Ayroso Fontanilla, 12871 Osborne, Arleta, CA (US) 91331-3335

( * ) Notice: Subject to any disclaimer, the term of this patent is extended or adjusted under 35 U.S.C. 154(b) by 340 days.

(21) Appl. No.: 11/041,461

(22) Filed: Jan. 24, 2005

(51) Int. Cl.
*A45C 11/20* (2006.01)

(52) U.S. Cl. ..... 206/541; 190/110

(58) Field of Classification Search ..... 206/541, 206/543, 545, 548, 549; 190/109, 110, 115, 190/124, 125; 383/109–111; 426/110, 119–120
See application file for complete search history.

(56) References Cited

U.S. PATENT DOCUMENTS

| | | | | |
|---|---|---|---|---|
| 1,458,679 | A | 6/1923 | Bishop | |
| 2,061,965 | A * | 11/1936 | Graeser | 206/541 |
| 2,627,970 | A | 2/1953 | Perkins | |
| 4,817,802 | A * | 4/1989 | Pratt | 206/579 |
| 5,042,664 | A * | 8/1991 | Shyr et al. | 190/109 |
| 5,090,526 | A * | 2/1992 | Jacober | 190/109 |
| 5,181,612 | A | 1/1993 | Liu | |
| 5,277,329 | A | 1/1994 | Pomroy et al. | |
| D351,536 | S | 10/1994 | Maydwell | |
| 5,485,921 | A | 1/1996 | Tolendano | |
| 5,501,338 | A * | 3/1996 | Preston | 206/545 |
| 5,595,302 | A | 1/1997 | Maydwell et al. | |
| D400,752 | S | 11/1998 | Guadalupi | |
| 5,842,571 | A | 12/1998 | Rausch | |
| 5,950,834 | A | 9/1999 | Woodnorth et al. | |
| 6,238,091 | B1 * | 5/2001 | Mogil | 383/110 |
| D463,960 | S | 10/2002 | McDonald | |
| 6,595,687 | B2 * | 7/2003 | Godshaw et al. | 383/110 |
| 7,004,323 | B1 * | 2/2006 | Symonds | 206/542 |

* cited by examiner

*Primary Examiner*—Luan K. Bui

(57) ABSTRACT

A versatile lunch box is provided, comprising a rectangular inner box unit with removably mounted compartment dividers within guide slots, an outer fabric cover with a zippered front flap having utensil and napkin holders and an inner pouch, with the outside of the fabric cover having a side pocket and pouch and a handle connected to the top. The versatile lunch box has particular utility in connection with accommodating large food items or multiple food items at different temperatures in a compact design that can easily fit inside a school bag or small office refrigerator.

19 Claims, 4 Drawing Sheets

VERSATILE LUNCH BOX

BACKGROUND OF THE INVENTION

1. Field of the Invention

The present invention relates to a versatile lunch box for use in connection with carrying meals. The versatile lunch box has particular utility in connection with accommodating large food items or multiple food items at different temperatures in a compact design that can easily fit inside a school bag or small office refrigerator.

2. Description of the Prior Art

Versatile lunch boxes are desirable for accommodating large food items or multiple food items at different temperatures in a compact design that can easily fit inside a school bag or small office refrigerator.

The use of lunch boxes is known in the prior art. For example, U.S. Pat. No. 5,595,302 to Maydwell et al. discloses a lunchbox. However, the lunchbox of the Maydwell '302 patent does not accommodate large food items or multiple food items at different temperatures, and additionally does not provide outside pockets or pouches for additional storage.

U.S. Pat. No. 5,950,834 to Woodnorth et al. discloses a lunch holder for holding a food product and a beverage container. However, the lunch holder of the Woodnorth '834 patent does not provide convenient holders for utensils or napkins, does not accommodate large food items or multiple food items at different temperatures, and additionally does not provide the convenience of a handle or outside pockets or pouches for additional storage.

U.S. Pat. No. 5,277,329 to Pomroy et al. discloses a lunch holder. However, the hunch holder of the Pomroy '329 patent is not versatile enough to accommodate large food items as well as multiple food items at different temperatures, does not provide convenient holders for utensils or napkins, and additionally does not provide the convenience of a handle or outside pockets or pouches for additional storage.

U.S. Pat. No. 400,752 to Crossman discloses a dinner pail. However, the Crossman '752 patent does not provide for large food items as well as multiple food items at different temperatures, and additionally does not provide for outside pockets or pouches for additional storage.

U.S. Pat. No. 5,181,612 to Liu discloses a compact collapsible lunch box. However, the Liu '612 patent does not provide for large food items as well as multiple food items at different temperatures, does not provide convenient holders for utensils or napkins, and additionally does not provide the convenience of a handle or outside pockets or pouches for additional storage.

U.S. Pat. No. 5,842,571 to Rausch discloses a compartmentalized soft-sided container. However, the Rausch '571 patent does not provide for large food items, and additionally does not provide outside pockets or pouches for additional storage.

U.S. Pat. No. 5,485,921 to Tolendano discloses a lunch box. However, the Tolendano '921 patent does not provide for large food items, and additionally does not provide for a handle for easy transport or outside pockets or pouches for additional storage.

U.S. Pat. No. 598,801 to Minter discloses a lunch box. However, the Minter '801 patent does not provide a compact apparatus, does not provide for convenient holders for utensils or napkins, and additionally does not provide outside pockets or pouches for additional storage.

U.S. Pat. No. 1,458,679 to Bishop discloses a camp and lunch kit. However, the Bishop '679 patent does not provide a compact lunch box, does not provide for multiple food items at different temperatures, and additionally does not provide for outside pockets or pouches for additional storage.

U.S. Pat. No. 2,061,965 to Graeser discloses a lunch box. However, the Graeser '965 patent does not provide for large food items as well as multiple food items at different temperatures, does not provide convenient holders for utensils or napkins, and additionally does not provide the convenience of outside pockets or pouches for additional storage.

U.S. Pat. No. 2,627,970 to Perkins discloses a picnic box. However, the Perkins '970 patent does not provide a compact lunch box, and additionally does not provide outside pockets or pouches for additional storage.

U.S. Pat. No. Des. 351,536 to Maydwell discloses a lunchbox. However, the Maydwell '536 patent does not provide for large food items or multiple food items at different temperatures, and additionally does not provide outside pockets or pouches for additional storage.

Lastly, U.S. Pat. No. Des. 463,960 to McDonald et al. discloses a lunch box. However, the McDonald '960 patent does not provide for large food items as well as multiple food items at different temperatures.

While the above-described devices fulfill their respective, particular objectives and requirements, the aforementioned patents do not describe a versatile lunch box that accommodates large food items or multiple food items at different temperatures, along with utensils and a beverage, in a compact design that can easily fit inside a school bag or small office refrigerator. The prior art patents make no provision for a compact lunch box with removable compartment dividers that can accommodate large food items as well as multiple food items at different temperatures, with convenient holders for utensils or napkins, a handle, and outside pockets or pouches for additional storage.

Therefore, a need exists for a new and improved versatile lunch box that can be used for accommodating large food items or multiple food items at different temperatures in a compact design that can easily fit inside a school bag or small office refrigerator. In this regard, the present invention substantially fulfills this need. In this respect, the versatile lunch box according to the present invention substantially departs from the conventional concepts and designs of the prior art, and in doing so provides an apparatus primarily developed for the purpose of accommodating large food items or multiple food items at different temperatures in a compact design that can easily fit inside a school bag or small office refrigerator.

SUMMARY OF THE INVENTION

In view of the foregoing disadvantages inherent in the known types of lunch boxes now present in the prior art, the present invention provides an improved versatile lunch box, and overcomes the above-mentioned disadvantages and drawbacks of the prior art. As such, the general purpose of the present invention, which will be described subsequently in greater detail, is to provide a new and improved versatile lunch box and method which has all the advantages of the prior art mentioned heretofore and many novel features that result in a versatile lunch box which is not anticipated, rendered obvious, suggested, or even implied by the prior art, either alone or in any combination thereof.

To attain this, the present invention essentially comprises a versatile lunch box, comprising an inner unit comprising side walls, at least one compartment divider connecting the side walls of the inner unit, an outer fabric cover around the inner unit, a front flap connected to the outer fabric cover, an attachment connecting the front flap to the outer fabric cover, a plurality of utensil holders connected to the front flap, a napkin holder connected to the front flap, an inner pouch connected to the front flap, a side pocket comprising an elastic upper edge with the side pocket connected to the outer fabric cover, a side pouch connected to the outer fabric cover, and a handle connected to the outer fabric cover.

In one embodiment, the present invention comprises a versatile lunch box, comprising an inner unit having side walls defining at least two guide slots therein, at least one removably mounted compartment divider configured to fit the guide slots, an outer fabric cover around the inner unit, a front flap connected to the outer fabric cover, a zipper connecting the front flap to the outer fabric cover, a plurality of utensil holders connected to the front flap, a napkin holder connected to the front flap, an inner pouch connected to the front flap, a side pocket comprising an elastic upper edge with the side pocket connected to the outer fabric cover, a side pouch connected to the outer fabric cover, and a handle connected to the outer fabric cover.

In another embodiment, the present invention comprises a versatile lunch box, comprising a rectangular inner box unit having side walls defining a plurality of guide slots therein, at least two removably mounted compartment dividers configured to fit the guide slots, an outer fabric cover around the rectangular inner box unit, a front flap connected to the outer fabric cover, a zipper connecting the front flap to the outer fabric cover, a plurality of utensil holders connected to the front flap, a napkin holder connected to the front flap, an inner pouch connected to the front flap, a side pocket comprising an elastic upper edge with the side pocket connected to the outer fabric cover, a side pouch connected to the outer fabric cover, and a handle connected to the outer fabric cover.

There has thus been outlined, rather broadly, the more important features of the invention in order that the detailed description thereof that follows may be better understood and in order that the present contribution to the art may be better appreciated.

The invention may also include additional guide slots, compartment dividers, holders, pouches, pockets, and attachments. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved versatile lunch box that has all of the advantages of the prior art lunch boxes and none of the disadvantages.

It is another object of the present invention to provide a new and improved versatile lunch box that may be easily and efficiently manufactured and marketed.

An even further object of the present invention is to provide a new and improved versatile lunch box that has a low cost of manufacture with regard to both materials and labor, and which accordingly is then susceptible of low prices of sale to the consuming public, thereby making such versatile lunch box economically available to the buying public.

Still another object of the present invention is to provide a new versatile lunch box that provides in the apparatuses and methods of the prior art some of the advantages thereof, while simultaneously overcoming some of the disadvantages normally associated therewith.

Even still another object of the present invention is to provide a versatile lunch box for accommodating large food items in a compact design that can easily fit inside a school bag or small office refrigerator. This allows an individual to conveniently carry a complete meal to work or school.

Still yet another object of the present invention is to provide a versatile lunch box for accommodating multiple food items at different temperatures in a compact design that can easily fit inside a school bag or small office refrigerator. This makes it possible for an individual to carry both hot and cold items for a more palatable meal away from home.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description males reference to the annexed drawings wherein.

The same reference numerals refer to the same parts throughout the various figures.

DESCRIPTION OF THE PREFERRED EMBODIMENT

Figure 1:
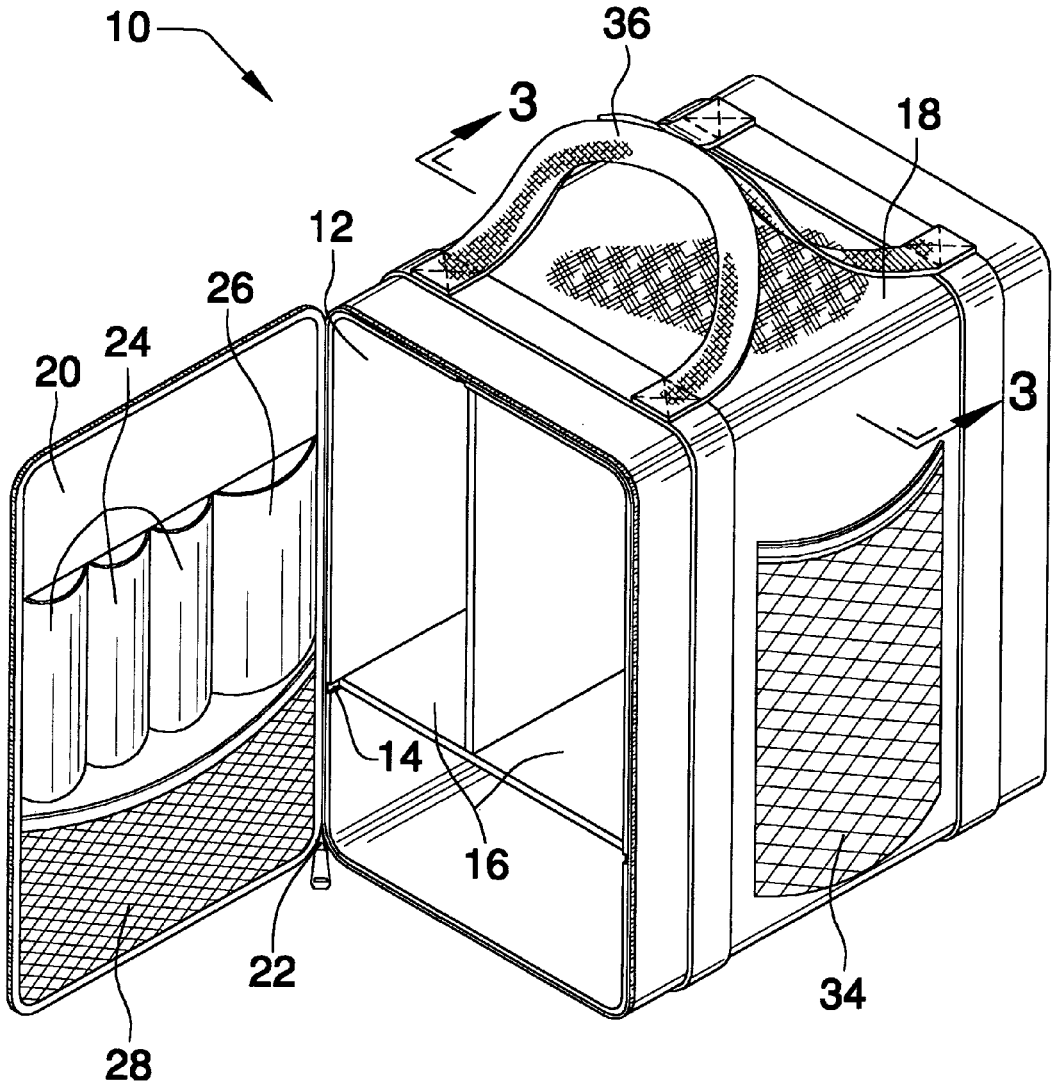
FIG. 1 is an isometric perspective view of the preferred embodiment of the open versatile lunch box constructed in accordance with the principles of the present invention.

Referring now to the drawings, and particularly to FIGS. 1-4, a preferred embodiment of the versatile lunch box of the present invention is shown and generally designated by the reference numeral 10.

In FIG. 1, a new and improved versatile lunch box 10 of the present invention for accommodating large food items or multiple food items at different temperatures in a compact design that can easily fit inside a school bag or small office refrigerator is illustrated and will be described. More particularly, in this embodiment the versatile lunch box 10 comprises a rectangular box inner unit 12 having side walls defining a plurality of guide slots 14 therein, at least two removably mounted compartment dividers 16 configured to fit the guide slots 14, an outer fabric cover 18 around the rectangular inner unit 12, a front flap 20 connected to the outer fabric cover 18, a zipper 22 connecting the front flap 20 to the outer fabric cover 18, a plurality of utensil holders 24 connected to the front flap 20, a napkin holder 26 connected to the front flap 20, an inner pouch 28 connected to the front flap 20, a side pouch 34 connected to the outer fabric cover 18, and a handle 36 connected to the outer fabric cover 18.

Figure 2:
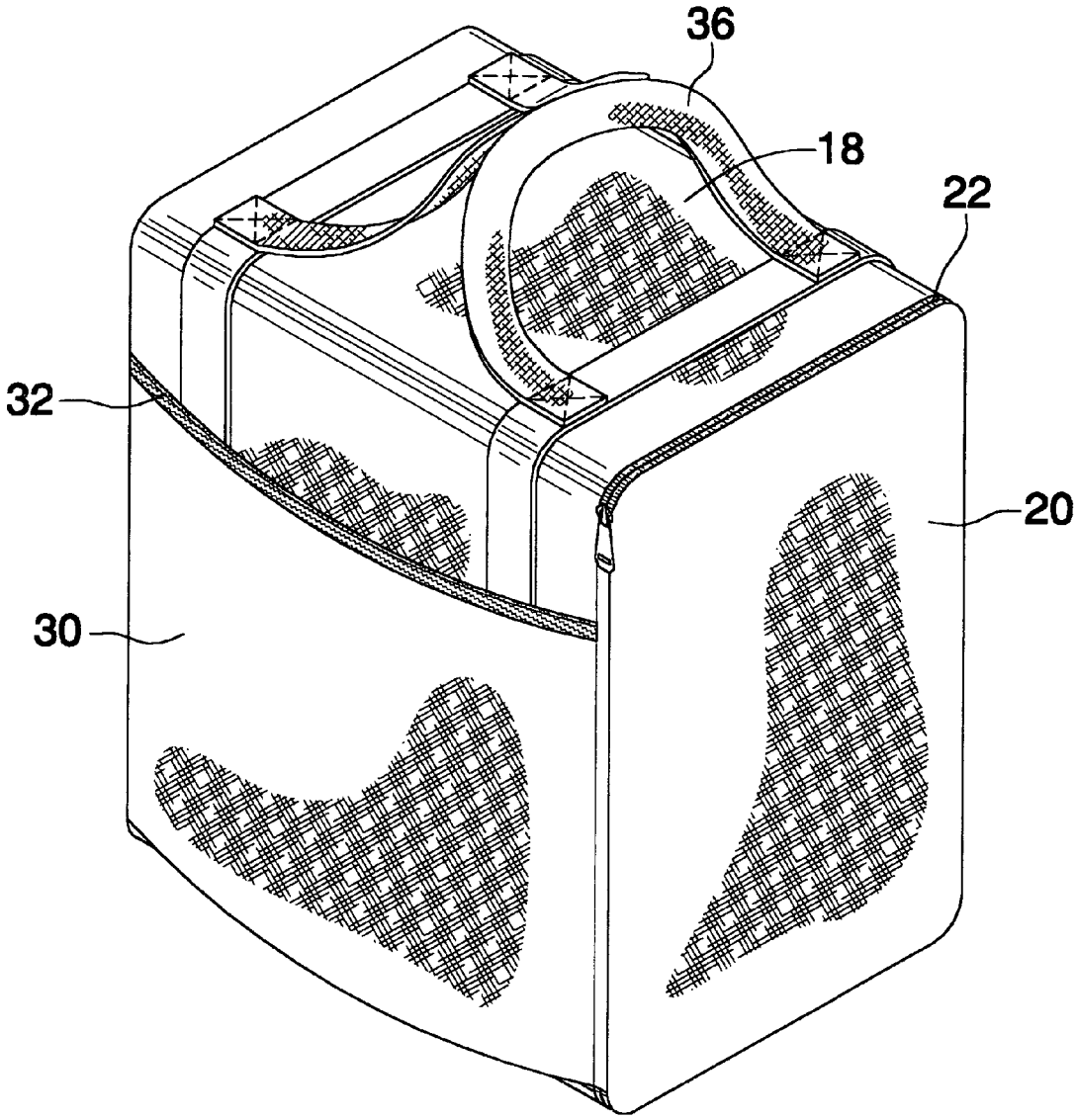
FIG. 2 is an isometric perspective view of the closed versatile lunch box of the present invention.

FIG. 2 is an isometric perspective view of the closed versatile lunch box of the present invention, and illustrates the outer fabric cover 18, a front flap 20 connected to the outer fabric cover 18, a zipper 22 connecting the front flap 20 to the outer fabric cover 18, a side pocket 30 comprising an elastic 32 upper edge with the side pocket 30 connected to the outer fabric cover 18, and a handle 36 connected to the outer fabric cover 18.

Figure 3:
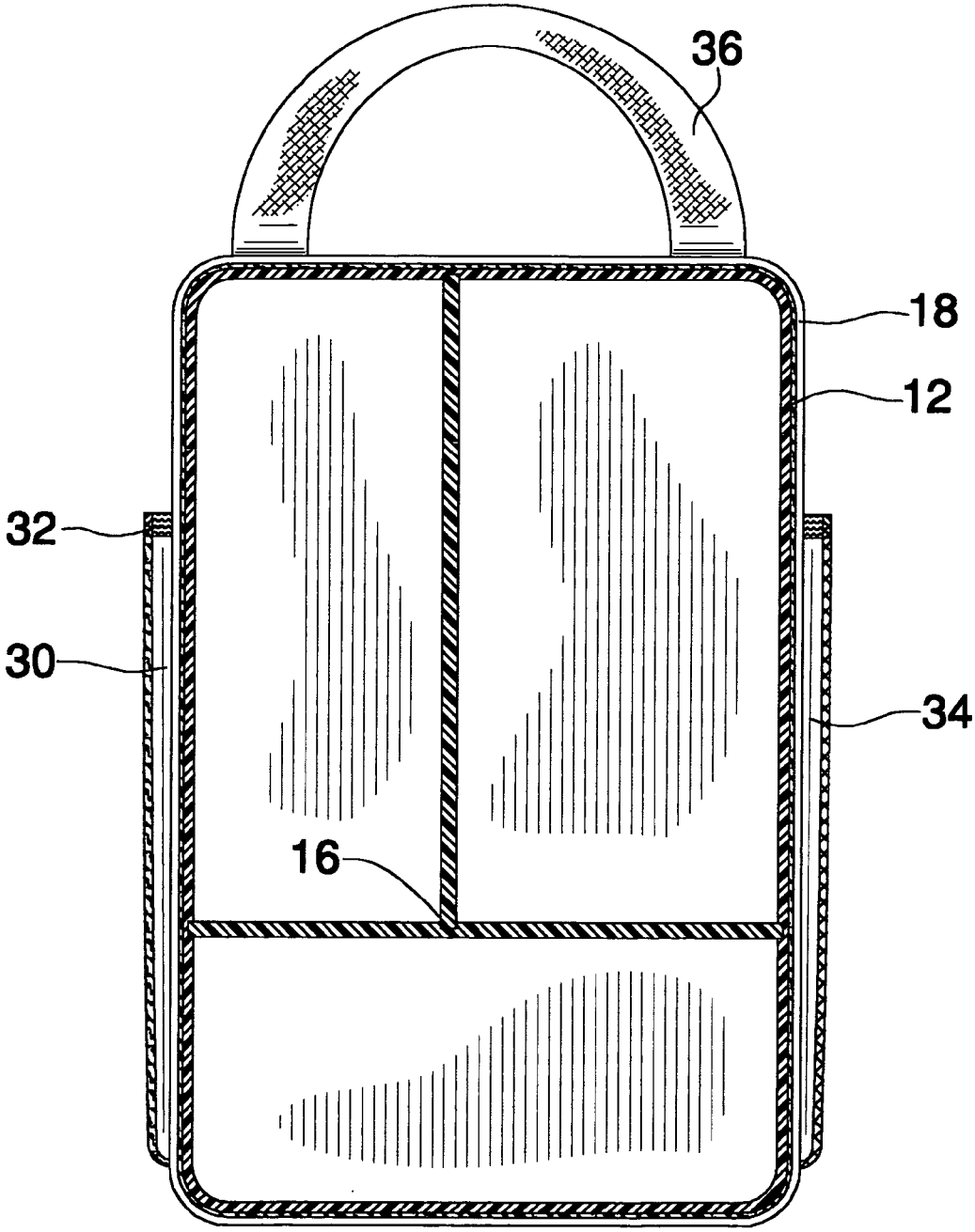
FIG. 3 is a side elevational cross-sectional view of the versatile lunch box of the present invention illustrated in FIG. 1 and taken along the line 3-3.

FIG. 3 is a side elevational cross-sectional view of the versatile lunch box of the present invention, and illustrates the rectangular box inner unit 12 with removably mounted compartment dividers 16, an outer fabric cover 18 around the rectangular inner unit 12, a side pocket 30 comprising an elastic 32 upper edge with the side pocket 30 connected to the outer fabric cover 18, a side pouch 34 connected to the outer fabric cover 18, and a handle 36 connected to the outer fabric cover 18.

Figure 4:
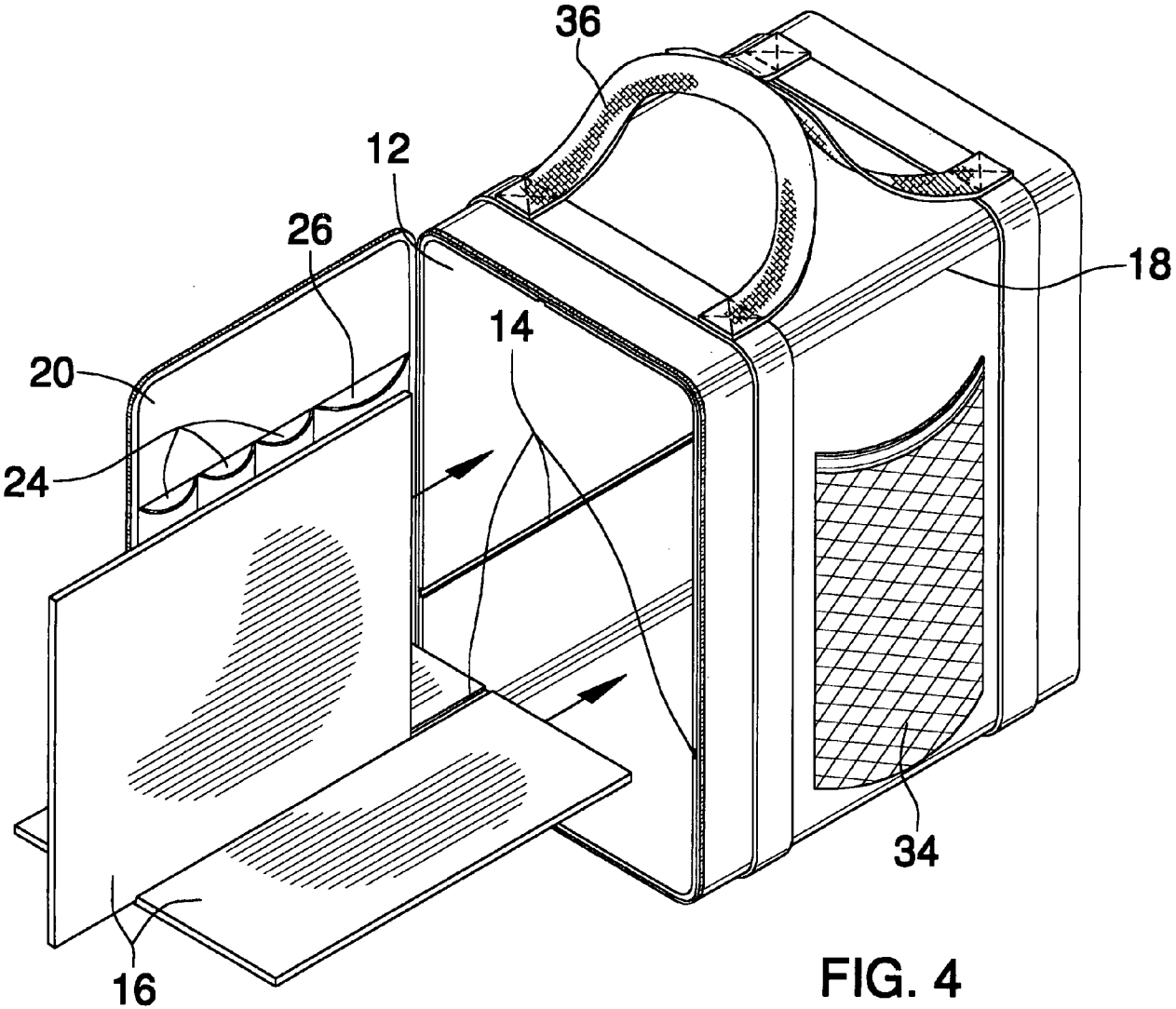
FIG. 4 is an isometric perspective view of the open versatile lunch box of the present invention with compartment dividers removed.

FIG. 4 is an isometric perspective view of the open versatile lunch box of the present invention with compartment dividers 16 removed, and illustrates the rectangular box inner unit 12 having side walls defining a plurality of guide slots 14 therein, at least two removably mounted compartment dividers 16 configured to fit the guide slots 14, an outer fabric cover 18 around the rectangular inner unit 12, a front flap 20 connected to the outer fabric cover 18, a plurality of utensil holders 24 connected to the front flap 20, a napkin holder 26 connected to the front flap 20, a side pouch 34 connected to the outer fabric cover 18, and a handle 36 connected to the outer fabric cover 18.

The versatile lunch box is a food carrier that is used to transport various food and beverages while eating away from home. This product has utility for individuals who carry their lunches to work or school.

In one embodiment, the versatile lunch box comprises a rectangular, plastic carrier with a series of separate compartments that are used to store a TV dinner, soda, utensils, etc. The versatile lunch box is easily carried to work or school. With this carrier, a person can enjoy various foods and a beverage while eating away from home. The carrier is simple to carry and economical to purchase. In addition, the versatile lunch box may be compactly stored inside a school bag. This rectangular lunch carrier may be produced from a dishwasher-safe plastic and in a wide variety of colors and styles to match any kitchen decor.

The versatile lunch box fulfills the need for a decorative carrier with separate compartments that provide for convenient storage and carrying of foods. The appealing features of the versatile lunch box include its convenience, versatility, portability, durability, effectiveness, and ease of use. Using this carrier, a person can have a broad selection of foods available to be eaten at work or school, during outdoor activities, or when traveling. The versatile lunch box appeals to a wide range of individuals who enjoy eating hot or cold foods when away from home. With this carrier, a wide variety of foods may be kept in separate sections. As a result, certain foods are easily placed into a microwave, while others are immediately consumed. The separate compact pockets allow this plastic carrier to be easily stored in a refrigerator to save space. The versatile lunch box features an adjustable, easy-to-grip handle for ease in storage and carrying. The versatile lunch box is dishwasher-safe, easy to use, simple to carry, practical, convenient, effective, and durable. With compartment dividers in place, foods at different temperatures can be stored in compartments that are thermally insulated from each other by virtue of the dividers. With the compartment dividers removed, large food items can be accommodated.

Embodiments of the versatile lunch box of the present invention incorporate many useful design features. The durable container can hold an entire meal, including a beverage and utensils, as well as a water bottle. The easy-to-carry unit incorporates a handle for increased comfort. It is a compact item that fits in a small office refrigerator without taking up much space, and helps to reduce the wasteful practice of packing a lunch in plastic or brown bags. The sturdy construction of the versatile lunch box holds contents upright, which prevents spills and leaks, and in certain embodiments dishwasher safe plastic ensures the container is easy to keep clean. In different embodiments, the versatile lunch box may comprise a variety of sizes, colors and patterns to appeal to both children and adults. A convenient feature of this apparatus is that a wide selection of food can be taken out easily without emptying the entire contents.

In certain embodiments, the meal carrier is a rectangular unit constructed from plastic, and features a series of separate internal compartments used to store numerous items, including utensils, a beverage and food. A durable handle is secured to the top of the container for simple transport, and a side pocket may feature a zipper closure for additional items such as napkins or towelettes. In addition, a pocket on one side of the unit can house reading materials such as books and magazines, or it may hold food containers and ice packs. This apparatus has utility for individuals of any household or workplace.

In one embodiment, the versatile lunch box comprises an inner unit comprising side walls, at least one compartment divider connecting the side walls of the inner unit, an outer fabric cover around the inner unit, a front flap connected to the outer fabric cover, an attachment connecting the front flap to the outer fabric cover, a plurality of utensil holders connected to the front flap, a napkin holder connected to the front flap, an inner pouch connected to the front flap, a side pocket comprising an elastic upper edge with the side pocket connected to the outer fabric cover, a side pouch connected to the outer fabric cover, and a handle connected to the outer fabric cover.

In another embodiment, the versatile lunch box comprises an inner unit having side walls defining at least two guide slots therein, at least one removably mounted compartment divider configured to fit the guide slots, an outer fabric cover around the inner unit, a front flap connected to the outer fabric cover, a zipper connecting the front flap to the outer fabric cover, a plurality of utensil holders connected to the front flap, a napkin holder connected to the front flap, an inner pouch connected to the front flap, a side pocket comprising an elastic upper edge with the side pocket connected to the outer fabric cover, a side pouch connected to the outer fabric cover, and a handle connected to the outer fabric cover.

In still another embodiment, the versatile lunch box comprises a rectangular inner box unit having side walls defining a plurality of guide slots therein, at least two removably mounted compartment dividers configured to fit the guide slots, an outer fabric cover around the rectangular inner box unit, a front flap connected to the outer fabric cover, a zipper connecting the front flap to the outer fabric cover, a plurality of utensil holders connected to the front flap, a napkin holder connected to the front flap, an inner pouch connected to the front flap, a side pocket comprising an elastic upper edge with the side pocket connected to the outer fabric cover, a side pouch connected to the outer fabric cover, and a handle connected to the outer fabric cover.

In some embodiments, the inner unit and compartment dividers of the versatile lunch box comprise a plastic material. In certain embodiments, the versatile lunch box concurrently accommodates hot and cold items. In other embodiments, compartment dividers are removed to accommodate a large food item.

In use, it can now be understood that the versatile lunch box of the present invention has particular utility in connection with accommodating large food items or multiple food items at different temperatures in a compact design that can easily fit inside a school bag or small office refrigerator.

While a preferred embodiment of the versatile lunch box has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as metal, or composite material may be used instead of the plastic described. Also, the outside may be made of synthetic or natural fabric material. And although accommodating large food items or multiple food items at different temperatures in a compact design that can easily fit inside a school bag or small office refrigerator has been described, it should be appreciated that the versatile lunch box herein described is also suitable for carrying items other than food. Furthermore, a wide variety of compartment designs may be used instead of that described. In addition, it is to be understood that the various described embodiments may be combined.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A versatile lunch box, comprising:

an inner unit comprising side walls;

at least one compartment divider having opposing sides, opposing ends, and a top surface with said opposing sides connecting said side walls of said inner unit, wherein said top surface of said at least one compartment divider defines a guide slot therein;

at least another compartment divider having opposing sides and opposing ends with one of said opposing ends removably inserted into said guide slot in said top surface of said at least one compartment divider, thereby protruding vertically from said top surface of said at least one compartment divider;

an outer fabric cover around said inner unit;

a front flap connected to said outer fabric cover;

an attachment connecting said front flap to said outer fabric cover;

a plurality of utensil holders connected to said front flap;

a napkin holder connected to said front flap;

an inner pouch connected to said front flap;

a side pocket comprising an elastic upper edge, said side pocket connected to said outer fabric cover;

a side pouch connected to said outer fabric cover; and a handle connected to said outer fabric cover.

2. The versatile lunch box of claim 1, comprising said opposing sides of said at least one compartment divider connecting said side walls of said inner unit.

3. The versatile lunch box of claim 1, wherein said attachment comprises a zipper.

4. The versatile lunch box of claim 1, wherein said inner unit comprises a rectangular box shape.

5. The versatile lunch box of claim 1, wherein said front flap comprises an inside surface and an outside surface, and wherein said utensil holders, said napkin holder, and said inner pouch are connected to said inside surface.

6. The versatile lunch box of claim 1, wherein said inner unit and said at least one compartment divider comprises a plastic material.

7. The versatile lunch box of claim 1, wherein said versatile lunch box concurrently accommodates items having different temperatures.

8. The versatile lunch box of claim 1, wherein said compartment dividers are removed to accommodate a large food item.

9. A versatile lunch box, comprising:

an inner unit having side walls defining at least two guide slots therein;

at least one removably mounted compartment divider having opposing sides, opposing ends, and a top surface with said opposing sides configured to fit said guide slots, wherein said top surface of said at least one removably mounted compartment divider defines a guide slot therein;

at least another removably mounted compartment divider having opposing sides and opposing ends with one of said opposing ends removably inserted into said guide slot in said top surface of said at least one removably mounted compartment divider, thereby protruding vertically from said top surface of said at least one removably mounted compartment divider;

an outer fabric cover around said inner unit;

a front flap connected to said outer fabric cover;

a zipper connecting said front flap to said outer fabric cover;

a plurality of utensil holders connected to said front flap;

a napkin holder connected to said front flap;

an inner pouch connected to said front flap;

a side pocket comprising an elastic upper edge, said side pocket connected to said outer fabric cover;

a side pouch connected to said outer fabric cover; and a handle connected to said outer fabric cover.

10. The versatile lunch box of claim 9, wherein said inner unit comprises a rectangular box shape.

11. The versatile lunch box of claim 9, wherein said front flap comprises an inside surface and an outside surface, and wherein said utensil holders, said napkin holder, and said inner pouch are connected to said inside surface.

12. The versatile lunch box of claim 9, wherein said inner unit and said at least one compartment divider comprises a plastic material.

13. The versatile lunch box of claim 9, wherein said versatile lunch box concurrently accommodates items having different temperatures.

14. The versatile lunch box of claim 9, wherein said compartment dividers are removed to accommodate a large food item.

15. A versatile lunch box, comprising:

a rectangular inner box unit having side walls defining a plurality of guide slots therein;

at least one removably mounted compartment divider having opposing sides, opposing ends, and a top surface with said opposing sides configured to fit said guide slots, wherein said top surface of at least one of said at least one removably mounted compartment dividers defines a guide slot therein;

at least another removably mounted compartment divider having opposing sides and opposing ends with one of said opposing ends removably inserted into said guide slot in said top surface of said at least one removably mounted compartment divider, thereby protruding vertically from said top surface of said at least one removably mounted compartment divider;

an outer fabric cover around said rectangular inner box unit;

a front flap connected to said outer fabric cover;

a zipper connecting said front flap to said outer fabric cover;

a plurality of utensil holders connected to said front flap;

a napkin holder connected to said front flap;

an inner pouch connected to said front flap;

a side pocket comprising an elastic upper edge, said side pocket connected to said outer fabric cover;

a side pouch connected to said outer fabric cover; and a handle connected to said outer fabric cover.

16. The versatile lunch box of claim 15, wherein said front flap comprises an inside surface and an outside surface, and wherein said utensil holders, said napkin holder, and said inner pouch are connected to said inside surface.

17. The versatile lunch box of claim 15, wherein said rectangular box unit and said compartment dividers comprise a plastic material.

18. The versatile lunch box of claim 15, wherein said versatile lunch box concurrently accommodates items having different temperatures.

19. The versatile lunch box of claim 15, wherein said compartment dividers are removed to accommodate a large food item.

* * * * *